US007198311B1

(12) United States Patent
Potts et al.

(10) Patent No.: US 7,198,311 B1
(45) Date of Patent: Apr. 3, 2007

(54) ELEVATOR FOR PIPE

(76) Inventors: David A. Potts, 80730 Gallatin Rd., Bozeman, MT (US) 59718; Paul R. Janke, 104 Redtail Hawk Dr., Belgrade, MT (US) 59714

( * ) Notice: Subject to any disclaimer, the term of this patent is extended or adjusted under 35 U.S.C. 154(b) by 0 days.

(21) Appl. No.: 11/256,286

(22) Filed: Oct. 14, 2005

Related U.S. Application Data

(60) Provisional application No. 60/618,742, filed on Oct. 14, 2004.

(51) Int. Cl.
*B66C 1/56* (2006.01)

(52) U.S. Cl. ..... 294/97; 294/86.24

(58) Field of Classification Search ..... 294/93–95, 294/97, 86.24, 86.25
See application file for complete search history.

(56) References Cited

U.S. PATENT DOCUMENTS

| | | | | | |
|---|---|---|---|---|---|
| 1,282,479 | A | * | 10/1918 | Smith | 294/86.14 |
| 1,540,566 | A | | 6/1925 | Petree | |
| 2,228,826 | A | | 1/1941 | Hill | |
| 2,487,902 | A | * | 11/1949 | Stout et al. | 29/283 |
| 2,610,888 | A | | 9/1952 | Pace | |
| 2,613,983 | A | * | 10/1952 | Knudsen | 294/97 |
| 2,759,757 | A | | 8/1956 | Pace | |
| 2,809,070 | A | * | 10/1957 | Nelson | 294/97 |
| 2,879,101 | A | * | 3/1959 | Daroci | 294/97 |
| 3,006,680 | A | | 10/1961 | Gregory | |
| 3,033,605 | A | * | 5/1962 | Morrow, Jr. | 294/97 |
| 3,355,792 | A | | 12/1967 | Cunningham | |
| 4,460,210 | A | | 7/1984 | Miechur | |
| 5,527,078 | A | * | 6/1996 | Messick | 294/95 |
| 6,511,113 | B1 | | 1/2003 | Kulage | |

* cited by examiner

*Primary Examiner*—Dean J. Kramer
(74) *Attorney, Agent, or Firm*—Richard C. Conover

(57) ABSTRACT

An elevator for lifting pipe having an exposed bottom edge or an internal groove. A channel member has one end hingedly connected to a rod adjacent a first end of the rod and has a second end connected to a sector-shaped plate. A tubular member is slidably positioned on the rod and is connected to the sector plate with a linkage which allows the sector plate to move from a collapsed position to a splayed-out position as the tubular member is moved toward or away from the sector plate. The sector plate, in the splayed-out position, may be positioned underneath the bottom exposed edge of the pipe or into the internal groove provided in the pipe as the case may be. Apparatus is connected to the rod for either raising or lowering the elevator.

3 Claims, 7 Drawing Sheets

ELEVATOR FOR PIPE

This application claims the benefit of provisional application Ser. No. 60/618,742 filed Oct. 14, 2004.

BACKGROUND OF INVENTION

The present invention relates to an elevator apparatus that is used to lift and lower conventional well pipe having a bottom exposed edge or an internal groove.

Various pipe extractors and pipe handling mechanisms are known including U.S. Pat. No. 1,540,566 to Petree and U.S. Pat. No. 2,759,757 to Pace. These mechanisms show apparatus having gripping fingers which are forced against the side of a pipe to enable the pipe to be either lifted or lowered in a well, for example.

The present invention provides a simple apparatus which utilizes gravity to engage the elevator with the pipe to be lifted. The apparatus according to the present invention provides apparatus which is easy to operate, simple in construction and which can be used very effectively in raising or lowering pipe.

SUMMARY OF THE INVENTION

The present invention relates to an elevator for lifting pipe having an exposed bottom edge or an internal groove and includes a rod having a first end and a second end. A channel member has one end hingedly connected to the rod adjacent the first end of the rod and the second end connected to a truncated, sector-shaped plate. A tubular member is slidably positioned on the rod and is connected to the sector plate with a linkage which allows the sector plate to move from a collapsed position against the rod when the tubular member is moved on the rod away from the sector plate to a splayed-out position spaced apart from the rod when the tubular member is moved on the rod toward the sector plate. The sector plate is sized so that when in the collapsed position the elevator may be lowered into the pipe and when in the splayed-out position may be positioned underneath the bottom exposed edge of the pipe or into the internal groove provided in the pipe, as the case may be. There is also provided apparatus connected to the rod adjacent the second end of the rod for either raising or lowering the elevator in a vertical direction.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
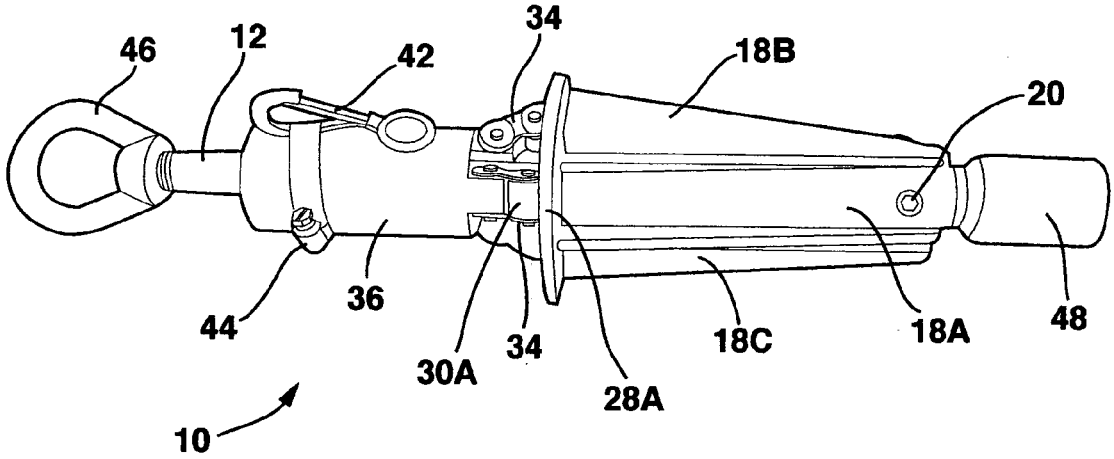
FIG. 1 is a top view of an elevator according to the present invention.
Figure 2:
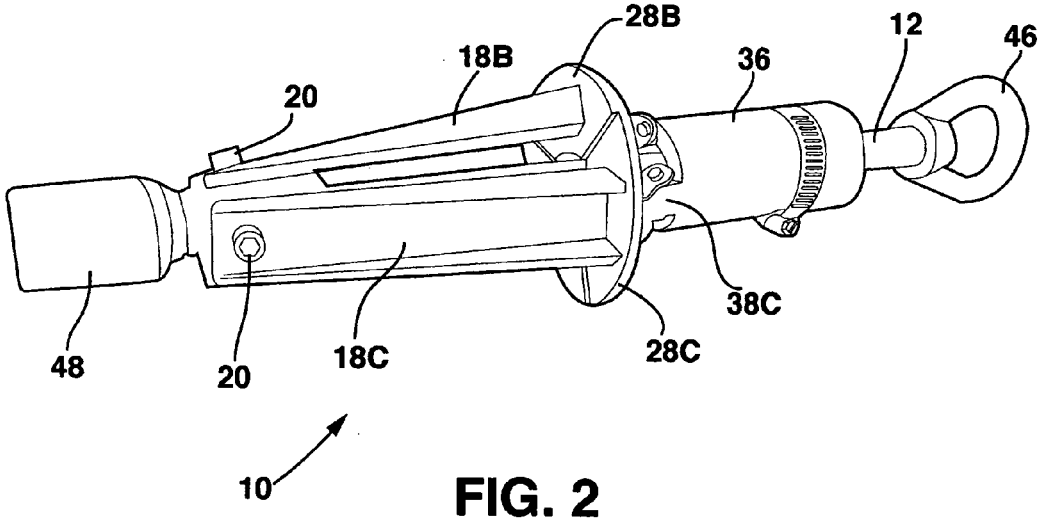
FIG. 2 is a bottom view of the invention shown in FIG. 1.
Figure 3:
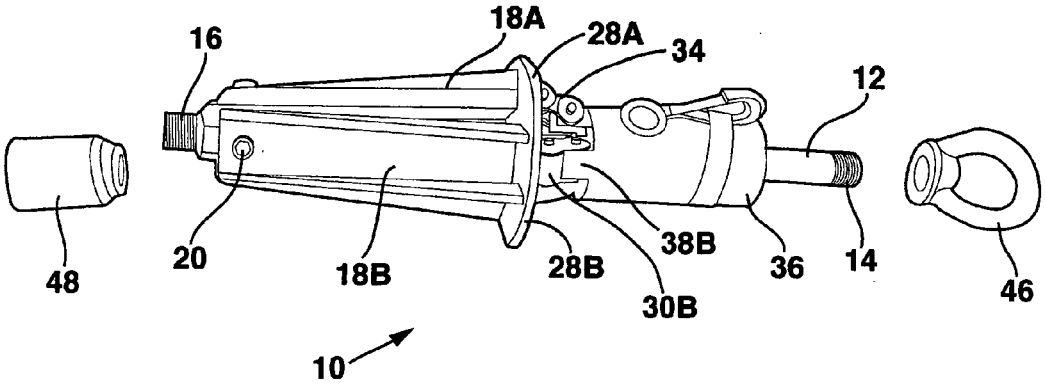
FIG. 3 is a exploded view of the invention shown in FIG. 1.

An elevator 10 according to the present invention is shown in FIGS. 1–4. The elevator 10 includes an elongate rod 12 having a threaded end 14 provided at one end thereof as shown in FIG. 3 and a threaded end 16 located at the opposite end thereof.

At the end of rod 12 adjacent the threaded end 16, three channel members 18A, 18B and 18C are bolted to rod 12 with bolts 20. In a preferred embodiment the channel members 18A, 18B and 18C have a tapered shape as shown in FIG. 2.

Figure 6:
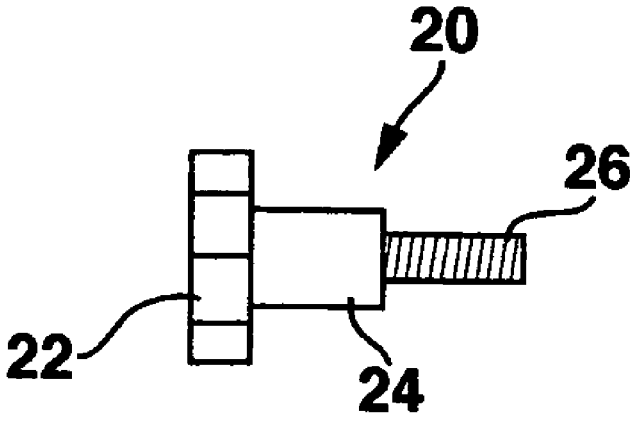
FIG. 6 is a top view of a bolt used with the present invention.

A detail of bolt 20 is shown in FIG. 6. The bolt 20 includes a head portion 22, a shoulder portion 24 and a threaded portion 26. The shoulder portion 24 of bolts 20 are received by a bore provided in each of the channel members 18A, 18B and 18C which holes are sized to have a diameter larger than the diameter of the shoulder 24 of bolt 20. The bolt 20 is threadably secured to rod 12 and is threaded into rod 12 until the shoulder 24 abuts the rod 12. In this manner, the bolts 20 secure members 18A, 18B and 18C to rod 12 in a loose fitting manner sufficient to allow the channel members 18A, 18B and 18C to hingedly move outwardly with respect to the rod 12.

Figure 5:
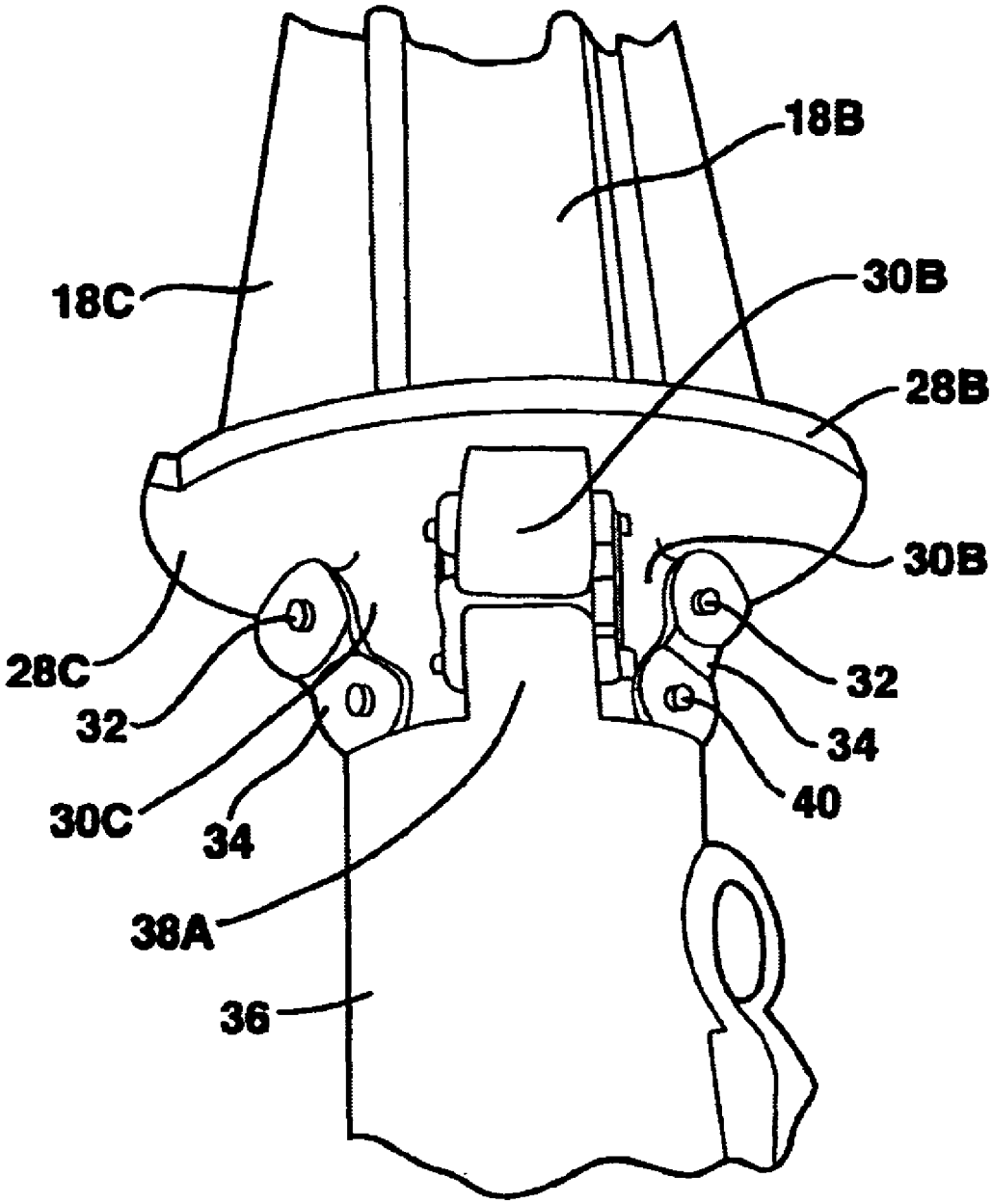
FIG. 5 is a detail view of a linkage used with the present invention.

The opposite end of members 18A, 18B and 18C are welded to three sector plates 28A, 28B and 28C, respectively. The sector plates have a truncated sector shape with the curved edge facing outwardly as best shown in FIG. 2 and FIG. 5. The sector plates 28A, 28B and 28C are arranged in equidistant relationship around the circumference of rod 12 as best shown in FIG. 2.

Each of the sector plates 28A, 28B and 28C are provided with mounting lugs 30A, 30B and 30C, respectively. Each of the mounting lugs 30A, 30B and 30C has a transverse bore (not shown) for receiving a pin 32 as shown in FIG. 5. The pin 32 is used for securing one end of a pair of roller chain connecting links 34 to the mounting lugs 30A, 30B and 30C.

A tubular member 36 is sized to slidably receive rod 12. Three dog members 38A, 38B and 38C are integrally formed with the tubular member 36. Each of the dog members 38A, 38B and 38C are provided with a transverse bore (not shown). A pin 40 is used for mounting the free ends of the roller chain connecting links 34 to the dog members 38A, 38B and 38C, respectively. A conventional clip is used to retain the pins 32 and 40 and roller chain connecting links 34 to the mounting lugs 30A, 30B and 30C and dogs 38A, 38B and 38C, respectively.

With this arrangement, as the tubular member 36 is moved on rod 12 away from the sector plates 28A, 28B and 28C, the sector plates are caused to be moved to a collapsed position against the rod 12. The sector plates are sized so that when the sector plates are at the collapsed position, the elevator 10 can be lowered inside a well pipe to be lifted. Further with this arrangement, as the tubular member 36 is moved on rod 12 toward the sector plate 28A, 28B and 28C, the sector plates are caused to be moved to a splayed-out position with respect to the rod 12.

An actuator clip 42 is mounted to the outside of tubular member 36 with a conventional hose clamp 44 as shown in FIG. 1.

Figure 7:
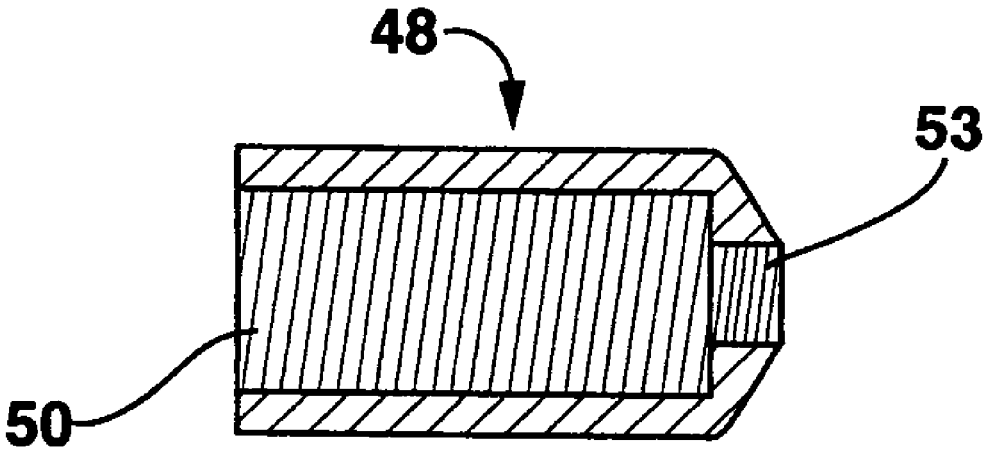
FIG. 7 is a cross-sectional view of a pipe connector used with the present invention.

When lowering the elevator 10 into the well pipe to be lifted, one of two attachments can be threaded onto the threads 14 provided on rod 12. The first attachment is a ring 46 which is threaded on the threads 14. With this attachment, a cable can be threaded through the ring 46 and used to lower the elevator 10 into the well pipe and also, as will be described, lift the weal pipe. The other attachment which can be used is the pipe coupler 48 which is shown in detail in FIG. 7. The pipe coupler includes an enlarged portion for receiving a threaded pipe portion 50 and also a reduced diameter threaded portion 53 for receiving the threads 14. When attachment 48 is to be used with the elevator 10 the coupler 48 is threaded onto the threads 14 and a section of pipe is threaded into threads 50 of the coupler 48. The pipe section can be then used to lower the elevator 10 into the well casing and can also be used for lifting the pipe, as will be described. When either of the two attachments 46 or 48 are not to be used, they can be stored by threading them onto the threads 16 provided at the opposite end of rod 12. FIG. 1 shows the ring attachment 46 to be used with the attachment 48 stored, for example.

Figure 8:
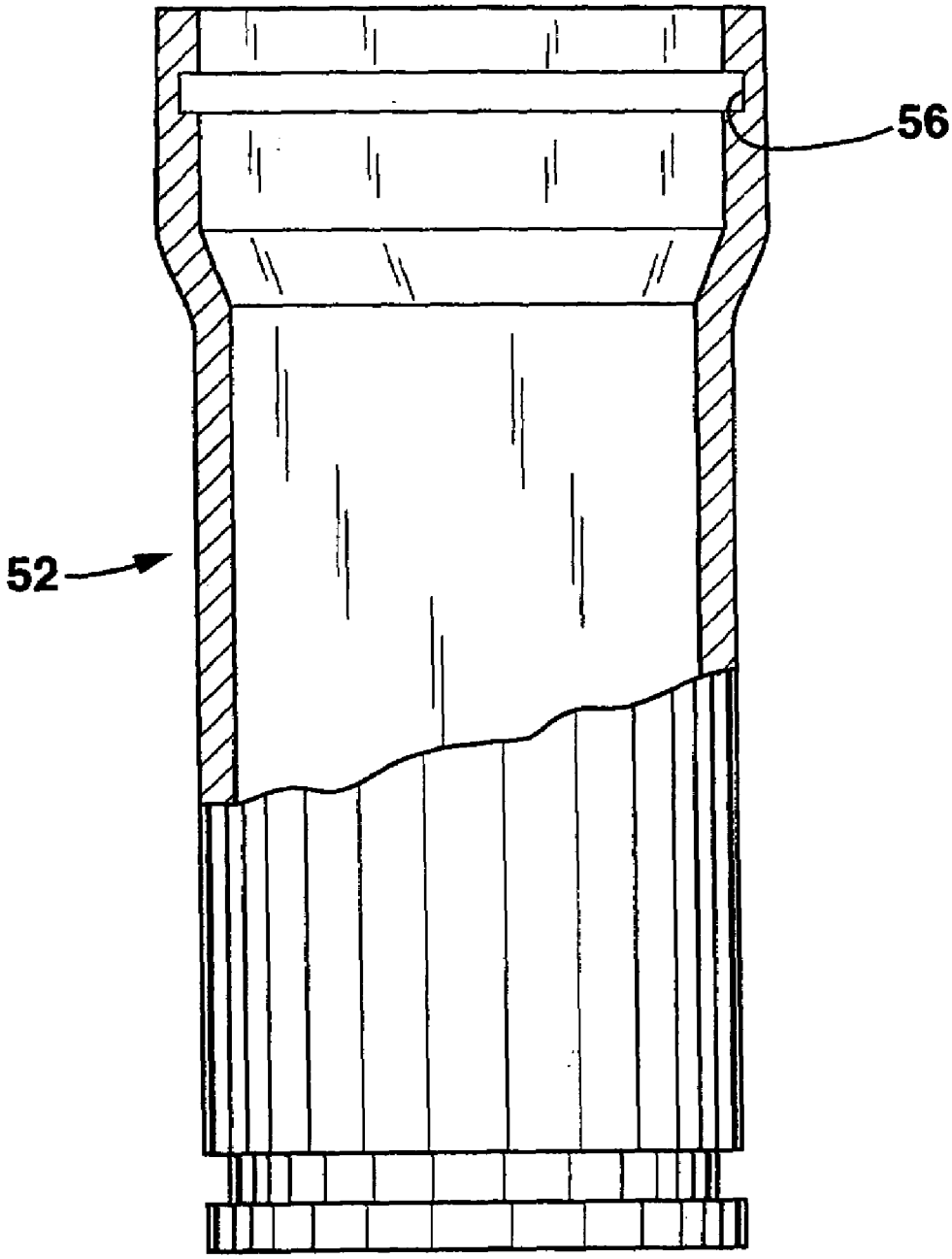
FIG. 8 is a elevational view partially in cross-section showing a conventional splined pipe used with the present invention.

In use, the channel members 18A, 18B and 18C are collapsed toward the rod 12 to a position as shown in FIG. 1. The elevator 10 is then dropped into the well pipe to be lifted using either the ring attachment 46 with a cable or the pipe attachment 48 with a pipe. The elevator 10, according to the present invention, can be used either to lift a conventional splined well pipe 52 as shown in FIG. 8 or a conventional bell end well casing 54 as shown in FIG. 9.

Figure 4:
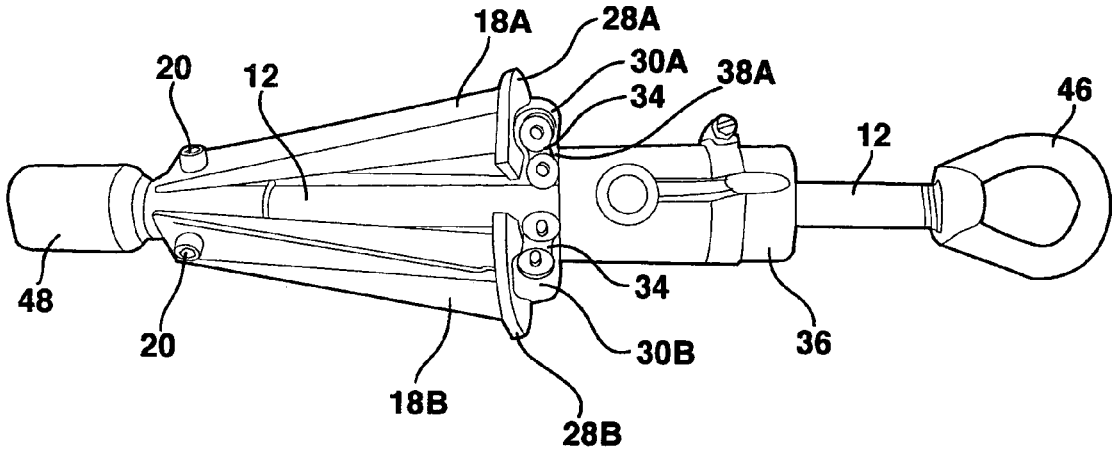
FIG. 4 is a top view of the invention shown in FIG. 1 with sector plates in a splayed-out position.

With respect to the splined well pipe 52, the splined well pipe is provided with an internal grove 56. The elevator 10, when used to lift the splined well pipe 52, is dropped into the pipe until the sector plates 28A, 28B and 28C are aligned with the groove 56 of the pipe section to be lifted. The tubular member 36, under the influence of gravity, moves toward the sector plates 28A, 28B and 28C causing the sector plates to move to the splayed-out position into the groove 56. The sector plates in the splayed out position are shown in FIG. 4. When this is accomplished, the well drilling rig using either a cable attached to ring connector 46 or pipe attached to pipe coupler 48 can lift the splined well pipe 52 upwardly.

The elevator 10 can also be used for lowering the splined well pipe 52 into a well being drilled. When the elevator 10 is used for lowering the splined pipe, the sector plates 28A, 28B and 28C are moved to the splayed-out position within the groove 56 of the splined pipe. The pipe is then lowered to the proper position. When it is desired to remove the elevator 10 from the splined well pipe 52, a line (not shown), which has been previously attached to the actuator clip 42, is pulled upwardly. This causes the tubular member 36 to move away from the sector plates, drawing the sector plates inwardly to the collapsed position and out of the groove 56. Now the elevator 10 can be completely removed from the splined well pipe 52.

Figure 9:
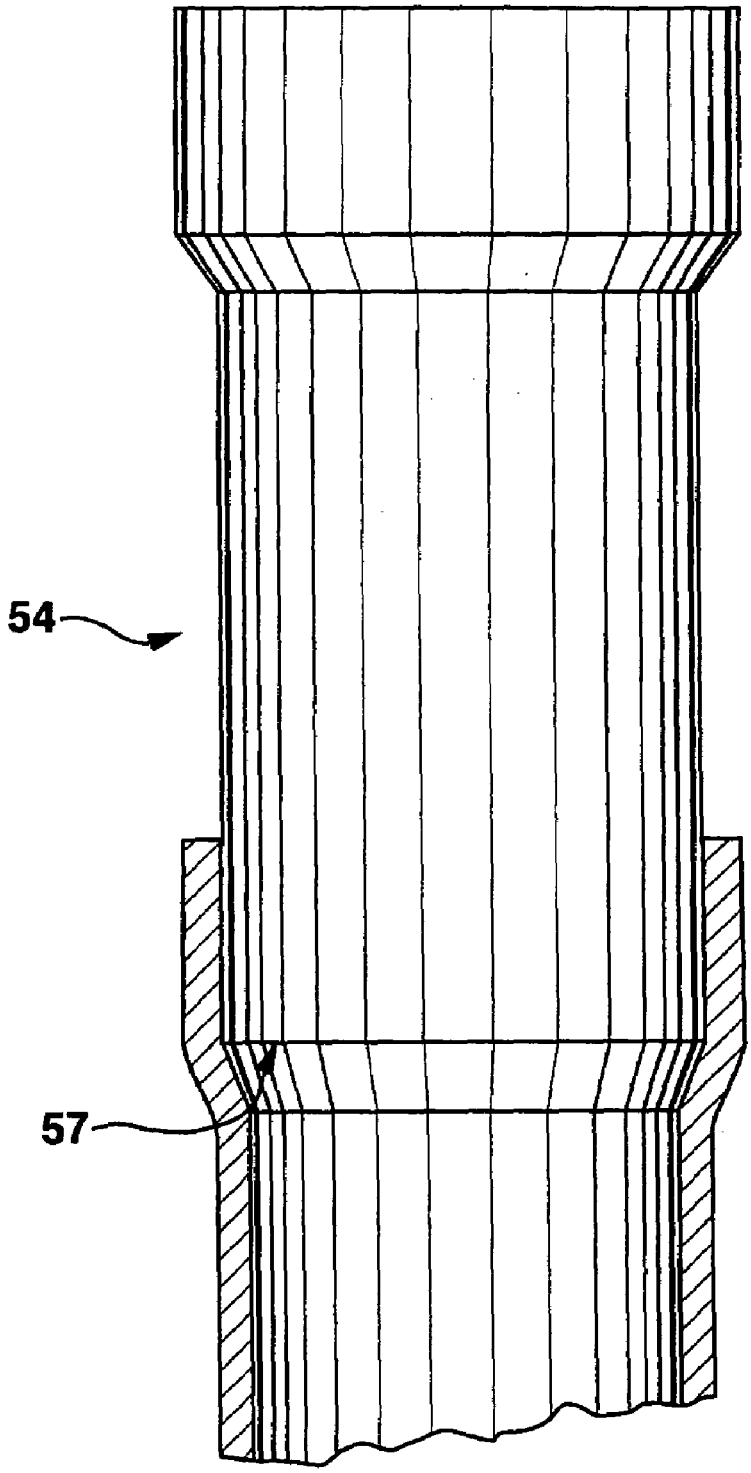
FIG. 9 is a elevational view partially in cross-section showing a conventional bell end well casing pipe used with the present invention.

The elevator 10 can also be used with bell end well casing pipe 54 as shown in FIG. 9. The manner of operation is the same as with splined pipe except that the sector plates 28A, 28B and 8C are positioned below the exposed bottom edge 57 of the bell casing 54 as shown in FIG. 9. The sector plates are gravity splayed-out underneath the bottom edge 56 of the pipe 54 and elevator 10 can be used to either raise or lower this pipe in a manner similar to that used with the splined pipe.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

We claim:

1. An elevator for lifting pipe having a bottom exposed edge or an internal groove comprising:

a rod having a first end and a second end;

an elongate member having a first end and a second end, the first end of the elongate member hingedly connected to the rod adjacent the first end of the rod;

a truncated sector-shaped plate associated with the elongate member;

the second end of each elongate member secured to one side of the sector plate with a curved edge of the sector plate facing outwardly;

a tubular member slidably positioned on the rod on the opposite side of the sector plate;

the sector plate connected to the tubular member with a roller chain linkage means for allowing the sector plate to move from a collapsed position against the rod when the tubular member is moved on the rod away from the sector plate to a splayed-out position spaced apart from the rod when the tubular member is moved on the rod toward the sector plate;

the sector plate sized so that when in the collapsed position, the elevator may be lowered through the pipe, and when in the splayed-out position, may be positioned underneath the bottom exposed edge of the pipe or into the internal groove provided in the pipe; and means connected to the rod adjacent the second end of the rod for either raising or lowering the rod in a vertical direction.

2. The elevator according to claim 1 further including means mounted to the tubular member to draw the tubular member away from the sector plate on the rod, causing the sector plate to move to the collapsed position.

3. The elevator according to claim 1 wherein three elongate members and three sector plates are arranged equidistant circumferentially around the rod.

* * * * *